US009437139B2

(12) United States Patent
Song et al.

(10) Patent No.: US 9,437,139 B2
(45) Date of Patent: Sep. 6, 2016

(54) PIXEL DRIVING CURRENT EXTRACTING APPARATUS AND PIXEL DRIVING CURRENT EXTRACTING METHOD

(71) Applicant: BOE TECHNOLOGY GROUP CO., LTD., Beijing (CN)

(72) Inventors: Danna Song, Beijing (CN); Liye Duan, Beijing (CN); Zhongyuan Wu, Beijing (CN); Cuili Gai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 57 days.

(21) Appl. No.: 14/362,004

(22) PCT Filed: Oct. 18, 2013

(86) PCT No.: PCT/CN2013/085520

§ 371 (c)(1),
(2) Date: May 30, 2014

(87) PCT Pub. No.: WO2015/003435

PCT Pub. Date: Jan. 15, 2015

(65) Prior Publication Data

US 2015/0302802 A1 Oct. 22, 2015

(30) Foreign Application Priority Data

Jul. 11, 2013 (CN) ..... 2013 1 0291322

(51) Int. Cl.
*G09G 5/10* (2006.01)
*G09G 3/32* (2016.01)

(52) U.S. Cl.
CPC ..... *G09G 3/3258* (2013.01); *G09G 3/3233* (2013.01); *G09G 2310/0248* (2013.01);
(Continued)

(58) Field of Classification Search
None
See application file for complete search history.

(56) References Cited

U.S. PATENT DOCUMENTS

2008/0252568 A1 10/2008 Kwon
2009/0066634 A1 3/2009 Isobe et al.
(Continued)

FOREIGN PATENT DOCUMENTS

CN 101427174 A 5/2009
CN 101430456 A 5/2009
(Continued)

OTHER PUBLICATIONS

Second Office Action (Chinese Language) from the State Intellectual Property Office of the People's Republic of China in Chinese Application No. 201310291322.1, dated Apr. 8, 2015; 4 pages.
(Continued)

*Primary Examiner* — Srilakshmi K Kumar
*Assistant Examiner* — Stephen T Reed
(74) *Attorney, Agent, or Firm* — Ladas & Parry LLP

(57) ABSTRACT

A pixel driving current extracting apparatus and a pixel driving current extracting method, the pixel driving current extracting apparatus comprises driving current extracting circuits corresponding to pixel driving circuits for respective colors respectively. Each of the driving current extracting circuits comprises a driving current amplifying and converting unit connected to the pixel driving circuit, for amplifying and converting a driving current of the pixel driving circuit into a voltage signal. A driving current computing unit connected to the driving current amplifying and converting unit is used for computing a pixel driving current according to the voltage signal. An amplification ratio of the driving current amplifying and converting unit in the driving current extracting circuits corresponding to the pixel driving circuits for respective colors is inversely proportional to a magnitude of the pixel driving current for respective colors. The pixel driving currents for respective colors are extracted uniformly and amplified properly without being distorted, thereby providing a well data support for the subsequent signal processing.

14 Claims, 4 Drawing Sheets

(52) U.S. Cl.
CPC ..... *G09G2310/0291* (2013.01); *G09G 2320/0242* (2013.01); *G09G 2320/0295* (2013.01); *G09G 2320/045* (2013.01); *G09G 2330/028* (2013.01)

(56) References Cited

U.S. PATENT DOCUMENTS

| | | | | |
|---|---|---|---|---|
| 2009/0127432 | A1* | 5/2009 | Lee | G01J 1/32 250/205 |
| 2010/0103159 | A1 | 4/2010 | Leon | |
| 2011/0227964 | A1* | 9/2011 | Chaji | G09G 3/006 345/690 |
| 2012/0056537 | A1 | 3/2012 | Koyama | |
| 2012/0256936 | A1* | 10/2012 | Lee | G09G 3/3225 345/549 |

FOREIGN PATENT DOCUMENTS

| | | | |
|---|---|---|---|
| CN | 101533636 | A | 9/2009 |
| CN | 102737577 | A | 10/2012 |
| CN | 103137072 | A | 6/2013 |
| CN | 103354081 | A | 10/2013 |
| CN | 203311819 | U | 11/2013 |
| KR | 10-2006-0075772 | A | 7/2006 |
| KR | 100846970 | B1 | 7/2008 |
| KR | 20080099537 | A | 11/2008 |
| KR | 20120025980 | A | 3/2012 |
| KR | 20130075789 | A | 7/2013 |
| WO | 2014/139198 | A1 | 9/2014 |

OTHER PUBLICATIONS

English translation of Second Office Action from the State Intellectual Property Office of the People's Republic of China in Chinese Application No. 201310291322.1, dated Apr. 8, 2015; 3 pages.

First Office Action from the Korean Patent Office Action in corresponding Korean application No. 10-2014-7017366, issued on May 14, 2015; 3 pages.

English translation of First Office Action from the Korean Patent Office Action in corresponding Korean application No. 10-2014-7017366, issued on May 14, 2015; 1 page.

PCT International Search Report for Application No. PCT/CN2013/085520, dated Apr. 25, 2015; 13 pgs.

First Office Action from the State Intellectual Property Office of the People's Republic of China in Chinese Application No. 201310291322.1, dated Dec. 3, 2014; 7 pages.

English translation of First Office Action from the State Intellectual Property Office of the People's Republic of China in Chinese Application No. 201310291322.1, dated Dec. 3, 2014; 8 pages.

English abstract of CN103354081A (listed above under Foreign Patent Documents); 1 pg.

English abstract of CN101427174A (listed above under Foreign Patent Documents); 1 pg.

English abstract of CN203311819U (listed above under Foreign Patent Documents); 1 pg.

Written Opinion of the International Searching Authority, in PCT Application No. PCT/CN2013/085520, dated Apr. 25, 2014, 5 pages.

English translation of Written Opinion of the International Searching Authority, in PCT Application No. PCT/CN2013/085520, dated Apr. 25, 2014, 5 pages.

English abstract of CN101533636A (foreign patent document above).

English abstract of CN101430456A (foreign patent document above).

English abstract of CN103137072A (foreign patent document above).

English abstract of CN102737577A (foreign patent document above).

English abstract of KR 10-2006-0075772 A (foreign patent document above).

Korean Notice of Allowance Appln. No. 10-2014-7017366; Dated Jan. 26, 2016.

* cited by examiner

PIXEL DRIVING CURRENT EXTRACTING APPARATUS AND PIXEL DRIVING CURRENT EXTRACTING METHOD

CROSS REFERENCE TO RELATED APPLICATIONS

This application is based on International Application No. PCT/CN2013/085520 filed on Oct. 18, 2013, which claims priority to Chinese National Application No. 201310291322.1 filed on Jul. 11, 2013. The entire contents of each and every foregoing application are incorporated herein by reference.

TECHNICAL FIELD OF THE DISCLOSURE

The present disclosure relates to the technical field of Organic Light Emitting Display (OLED), and particularly to a pixel driving current extracting apparatus and a pixel driving current extracting method.

BACKGROUND

Compared to a conventional liquid crystal panel, an Active Matrix/Organic Light Emitting Diode (AMOLED) display panel has advantages such as a faster response speed, a higher contrast, a wider angle of view, or the like. Therefore, the AMOLED has drawn more and more attention to display technology developers.

The AMOLED display panel is capable of emitting light because of being driven by a current generated by driving a Thin Film Transistor (TFT) in a saturated state. Since different driving currents may be generated by different critical voltages when the same grayscale voltage is input, it results in an inconsistency of the currents, and thus a non-uniformity of the screen display. In order to obtain information on the inconsistency as described above, the driving current of each pixel may be extracted. After the driving current of each pixel is obtained, the driving voltage of each pixel may be modified to reform the non-uniformity of the screen display.

Since the emitting efficiencies of pixels for a red color, a green color and a blue color of the AMOLED display panel are different, there is also difference among the magnitudes of the driving currents in pixels for respective colors. Thus, when the driving current is extracted, the times for charging storage capacitors by the driving currents of pixels for respective colors are inconsistent if operational amplifiers with the same amplification ratio are employed. For example, the charging time required for a larger driving current is shorter, while the charging time required for a smaller driving current is longer. Thereby, the resulting data is non-uniform.

SUMMARY

In view of the disadvantages in the prior art, a technical problem to be solved by the present disclosure is to provide a pixel driving current extracting apparatus and a pixel driving current extracting method which is capable of obtaining uniform data to provide a well data support for the subsequent signal processing.

According to an aspect of the present disclosure, a pixel driving current extracting apparatus is provided, comprising driving current extracting circuits corresponding to pixel driving circuits for respective colors respectively, each of the driving current extracting circuits comprising: a driving current amplifying and converting unit connected to the pixel driving circuit, for amplifying and converting a driving current of the pixel driving circuit into a voltage signal; and a driving current computing unit connected to the driving current amplifying and converting unit, for computing a pixel driving current according to the voltage signal; wherein, an amplification ratio of the driving current amplifying and converting unit in the driving current extracting circuits corresponding to the pixel driving circuits for respective colors is inversely proportional to a magnitude of the pixel driving current for respective colors.

Optionally, the driving current amplifying and converting unit comprises a first amplifier and a first capacitor; a first input terminal of the first amplifier is connected to an end of the first capacitor and the pixel driving circuit corresponding to the driving current extracting circuit, and a second input terminal of the first amplifier is connected to a reference voltage; an output terminal of the first amplifier is connected to the other end of the first capacitor and the driving current computing unit; the amplification ratio of the first amplifier in the driving current extracting circuits corresponding to the pixel driving circuits for respective colors is inversely proportional to the magnitude of the pixel driving current for respective colors.

Optionally, the driving current amplifying and converting unit further comprises a first switch connected in parallel with the first capacitor.

Optionally, the pixel driving current extracting apparatus comprises driving current extracting circuits corresponding to the pixel driving circuits for a red color, a green color and a blue color, respectively; among the driving current extracting circuits corresponding to the pixel driving circuits for the red color, the green color and the blue color, the amplification ratio of the first amplifier in the driving current extracting circuit corresponding to the pixel driving circuit for the green color is the largest, and the amplification ratio of the first amplifier in the driving current extracting circuit corresponding to the pixel driving circuit for the blue color is the smallest.

Optionally, the driving current computing unit is used for performing the operations of differentiating and amplifying after dividing the voltage signal, to obtain the pixel driving current.

Optionally, the driving current extracting apparatus further comprises a first switch connected in parallel with the first capacitor; the driving current computing unit comprises a second amplifier, a second switch, a third switch, a second capacitor and a third capacitor; the output terminal of the first amplifier is connected to an end of the second switch and an end of the third switch, respectively; the other end of the second switch is connected to an end of the second capacitor and a first input terminal of the second amplifier, respectively, and the other end of the second capacitor is grounded; the other end of the third switch is connected to an end of the third capacitor and a second input terminal of the second amplifier, respectively, and the other end of the third capacitor is grounded.

Optionally, the first switch, the second switch and the third switch are all switch transistors.

Optionally, the first switch, the second switch and the third switch are connected to a timing controller, respectively, the timing controller being used for controlling on-off timings of the first switch, the second switch and the third switch.

Optionally, the driving current computing unit further comprises a differential analog to digital converter connected to an output terminal of the second amplifier, the differential analog to digital converter being used for converting an analog signal into a digital signal.

Optionally, the first amplifier is an operational amplifier for converting an input current into a voltage, and the second amplifier is a fully differential operational amplifier for computing and amplifying a voltage difference between the second capacitor and the third capacitor.

According to another aspect of the present disclosure, there provides a pixel driving current extracting method for any of the above pixel driving current extracting apparatus, comprising the steps of: extracting a driving current, amplifying and converting the driving current of a pixel driving circuit into a voltage signal; and computing the driving current to perform the operations of differentiating and amplifying after dividing the voltage signal to obtain a pixel driving current; wherein, an amplification ratio of the pixel driving current for respective colors is inversely proportional to a magnitude of the pixel driving current for respective colors.

Optionally, the pixel driving current extracting method may further comprise the steps of: a step S1: turning on a first switch, a second switch and a third switch, to reset a voltage of an output terminal of a first amplifier to a reference voltage; a step S2: turning off the first switch, to charge a first capacitor by a current flowed from the pixel driving circuit; and a step S3: turning off the second switch and the third switch sequentially to obtain voltage values of a second capacitor and a third capacitor, and computing and amplifying a voltage difference between the second capacitor and the third capacitor by a second amplifier.

Optionally, a step S4 may be comprised after the step S3: inputting the amplified voltage difference into a differential analog to digital converter, to obtain a digital signal.

The pixel driving current extracting apparatus provided in the embodiments of the present disclosure sets up a larger amplification ratio for a pixel with a higher light emitting efficiency (i.e., for a smaller driving current) and a smaller amplification ratio for a pixel with a lower light emitting efficiency (i.e., for a larger driving current) selectively, according to the magnitudes of the pixel driving currents of the pixels for respective colors. Therefore, the following advantageous effects can be obtained that the pixel driving currents for respective colors are extracted uniformly and amplified properly while being ensured without distortion, thereby providing a well data support for a subsequent signal processing.

Figure 1:
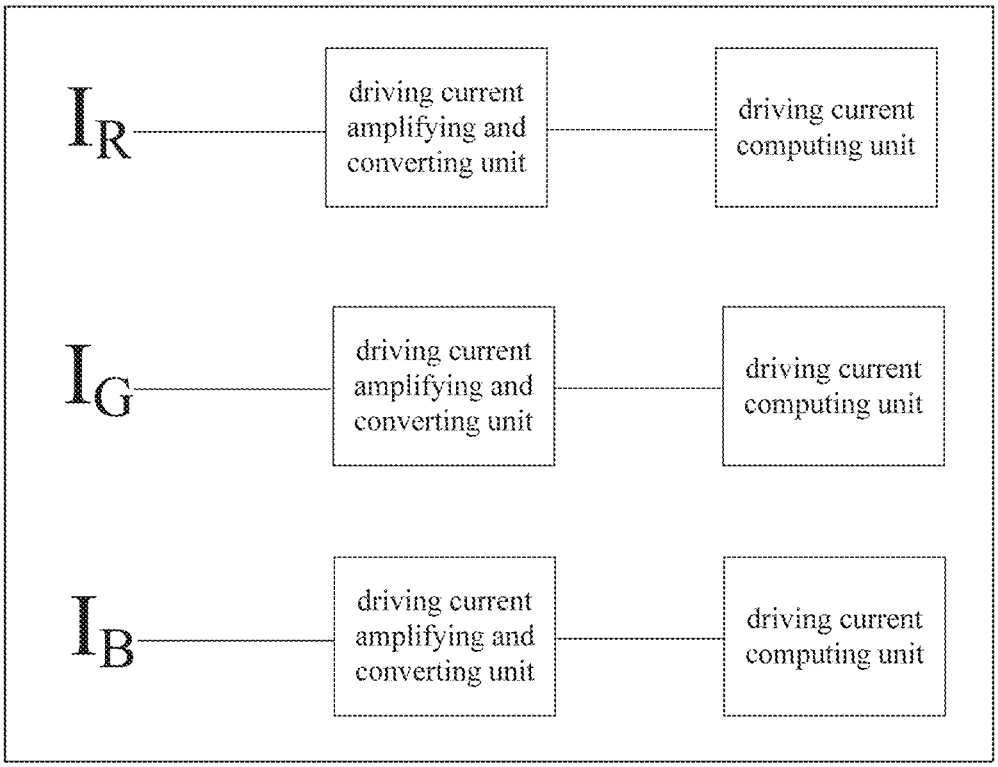
FIG. 1 is a schematic diagram showing module connections in a pixel driving current extracting apparatus in an embodiment of the present disclosure.

Meanings of the reference numerals in the accompanying drawings:

1: first amplifier;
2: second amplifier;
3: differential analog to digital converter;
4: pixel driving circuit.

DETAILED DESCRIPTION

The implementations of the present disclosure will be further described with reference to the accompanying drawings and the embodiments. The following embodiments are only for explaining the principle of the present disclosure, and are not for limiting the protection scope of the present disclosure.

As shown in FIG. 1, in the present exemplary embodiment, firstly, there provides a pixel driving current extracting apparatus, comprising driving current extracting circuits corresponding to pixel driving circuits for respective colors respectively, each of the driving current extracting circuits mainly comprising: a driving current amplifying and converting unit connected to the pixel driving circuit, for amplifying and converting a driving current of the pixel driving circuit into a voltage signal; and a driving current computing unit connected to the driving current amplifying and converting unit, for computing a pixel driving current according to the voltage signal; wherein, an amplification ratio of the driving current amplifying and converting unit in the driving current extracting circuits corresponding to the pixel driving circuits for respective colors is inversely proportional to a magnitude of the pixel driving current for respective colors.

In the present embodiment, the pixels for respective colors are a red pixel (R), a green pixel (G) and a blue pixel (B). The pixel driving currents $I_R$, $I_G$ and $I_B$ for the three colors are input to the driving current amplifying and converting unit respectively, which converts the input current signal into the voltage and inputs the voltage to the driving current computing unit to obtain the required driving current value.

Figure 2:
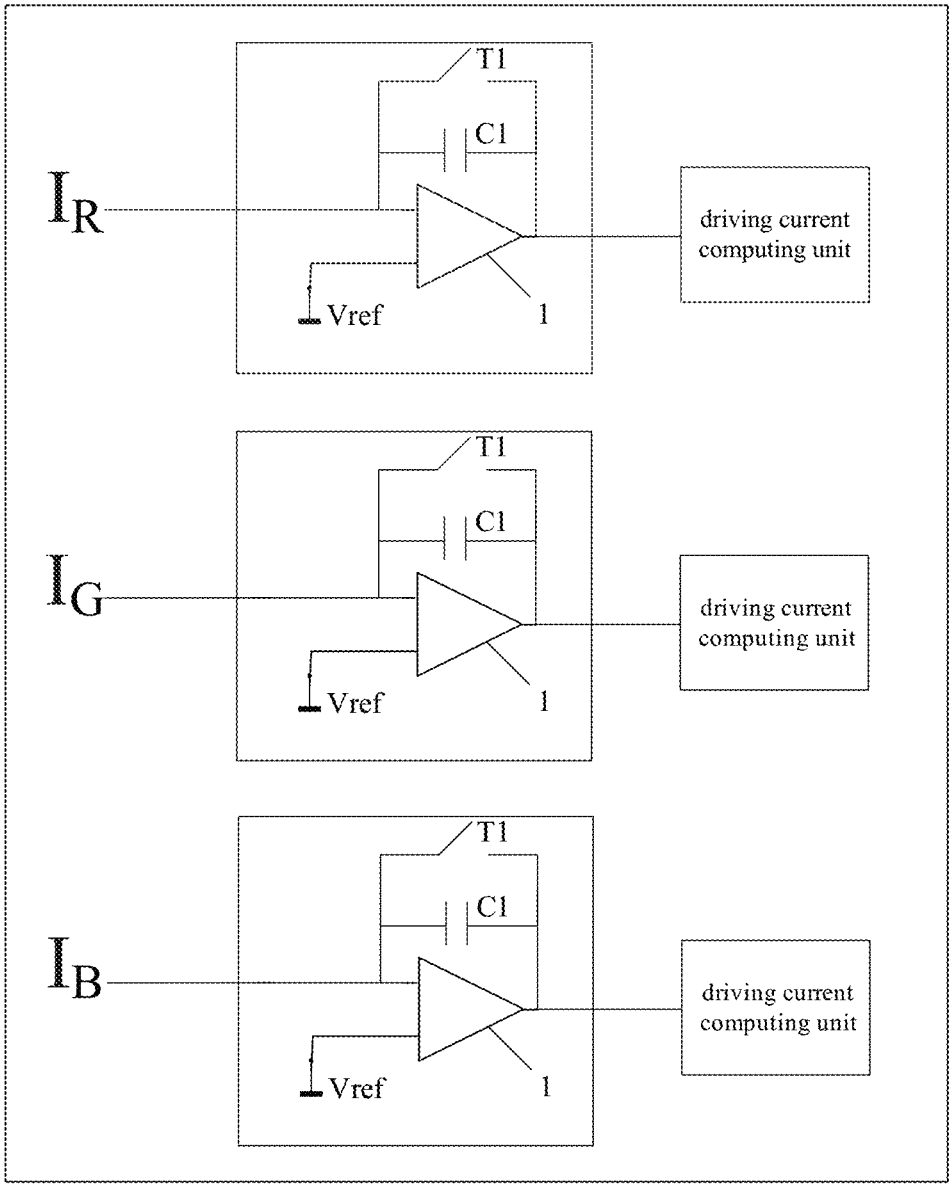
FIG. 2 is a schematic diagram showing an implemented structure of the driving current extracting apparatus in the embodiment of the present disclosure.

As shown in FIG. 2, in the present embodiment, the driving current amplifying and converting unit mainly comprises a first amplifier 1 and a first capacitor C1. The first amplifier 1 may be an operational amplifier mainly for amplifying the input current into the voltage and amplifying the voltage. A first input terminal of the first amplifier 1 is connected to an end of the first capacitor C1 and the pixel driving circuit corresponding to the driving current extracting circuit, respectively. A second input terminal of the first amplifier 1 is connected to a reference voltage Vref. The pixel driving circuit is mainly used for providing the driving current to the pixel for a respective color. An output terminal of the first amplifier 1 is connected to the other end of the first capacitor C1 and the driving current computing unit, respectively. In order to extract the driving currents of the pixels for respective colors uniformly, in the present embodiment, the amplification ratio of the first amplifier 1 in the driving current extracting circuit corresponding to the pixel driving circuit for a respective color is inversely proportional to a magnitude of the pixel driving current for respective colors. For example, the light emitting efficiency of the green pixel is the highest, and thus the driving current of the green pixel is the smallest. The light emitting efficiency of the blue pixel is the lowest, and thus the driving current of the blue pixel is the largest. Therefore, the amplification ratio of the first amplifier 1 in the driving current extracting circuit corresponding to the green pixel driving circuit is the largest, then the amplification ratio of the first amplifier 1 in the driving current extracting circuit corresponding to the red pixel driving circuit, and the amplification ratio of the first amplifier 1 in the driving current extracting circuit corresponding to the blue pixel driving circuit is the smallest. In this way, the charging time required for the larger driving current is shorten, and the charging time required for the smaller driving current is prolonged properly, and finally the times for charging the first capacitors C1 by the driving currents of the pixels for respective colors are made to be almost the same, and thereby the resulting data is uniform.

Figure 3:
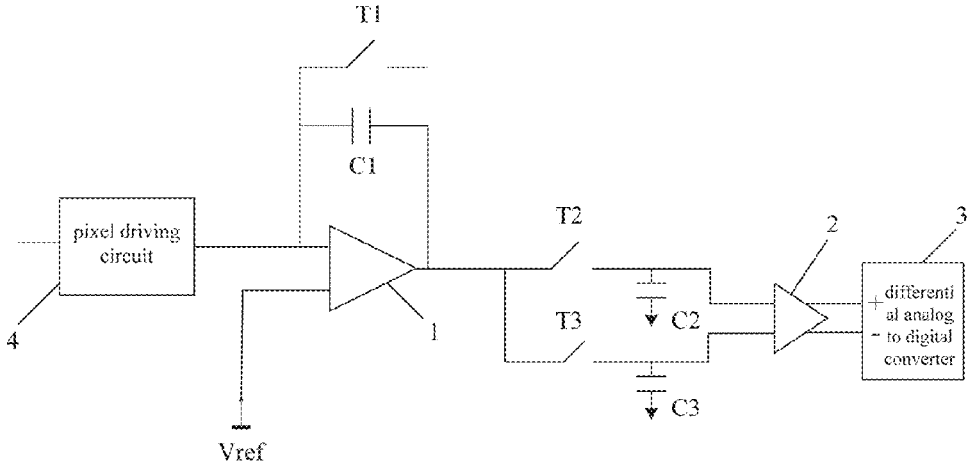
FIG. 3 is another schematic diagram showing an implemented structure of the driving current extracting apparatus in the embodiment of the present disclosure.

The circuit in FIG. 3 is an alternative implementation of the above driving current extracting apparatus. As shown in FIG. 3, the driving current extracting apparatus further comprises a first switch T1 connected in parallel with the first capacitor C1. The driving current computing unit comprises a second amplifier 2, a second switch T2, a third switch T3, a second capacitor C2, a third capacitor C3, or the like. The output terminal of the first amplifier 1 is connected to an end of the second switch T2 and an end of the third switch T3, respectively. The other end of the second switch T2 is connected to an end of the second capacitor C2 and a first input terminal of the second amplifier T2, respectively. The other end of the second capacitor C2 is grounded. The other end of the third switch T3 is connected to an end of the third capacitor C3 and a second input terminal of the second amplifier 2, respectively. The other end of the third capacitor C3 is grounded. The second amplifier 2 is mainly used for computing and amplifying a voltage difference between the second capacitor C2 and the third capacitor C3, which is optionally a fully differential operational amplifier. Finally, the output terminal of the second amplifier C2 is connected to a differential analog to digital (A/D) converter 3 for converting the analog signal output from the second amplifier 2 into a digital signal for the convenience of the subsequent processing.

Figure 4:
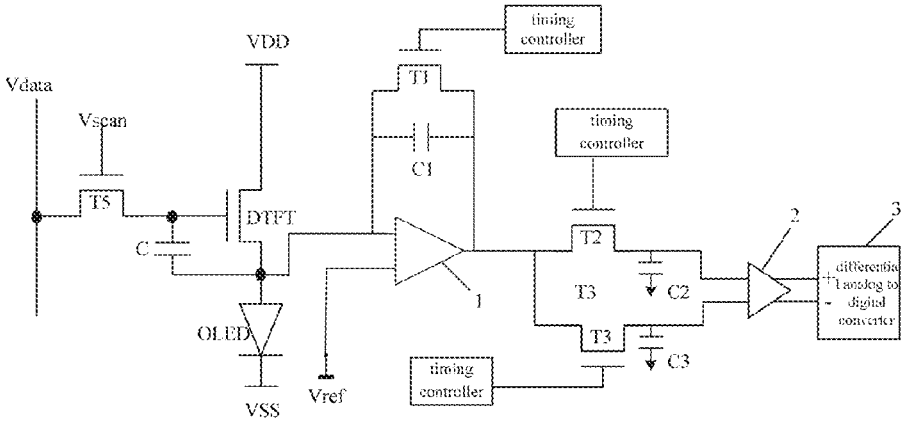
FIG. 4 is still another schematic diagram showing an implemented structure of the driving current extracting apparatus in the embodiment of the present disclosure.

As shown in FIG. 4, the pixel driving circuit is of a typical 2T1C structure, that is, comprises a switch transistor T5, a driving transistor DTFT and a storage capacitor C. The drain of the driving transistor DTFT provides the pixel driving current. The input terminal of the first amplifier 1 is connected to the drain of the driving transistor DTFT. For the convenience of the timing control, the first switch T1, the second switch T2 and the third switch T3 may all be switch transistors or other controllable analog switches. In the present embodiment, the first switch T1, the second switch T2 and the third switch T3 are all switch transistors. Then, the first switch T1, the second switch T2 and the third switch T3 are connected to a timing controller, respectively, the timing controller being used for controlling on-off timings of the first switch T1, the second switch T2 and the third switch T3, respectively.

A pixel driving current extracting method implemented based on the above driving current extracting apparatus is further provided by the present disclosure, which mainly comprises a driving current extracting process and a driving current computing process. The main improvement of the driving current extracting method in the embodiment of the present disclosure lies in that, the amplification ratio of the pixel driving current for a respective color is inversely proportional to a magnitude of the pixel driving current for respective colors in the driving current extracting process. In this way, the charging time required for the larger driving current is shorten, and the charging time required for the smaller driving current is prolonged properly, so that finally the times for charging the first capacitors C1 by the driving currents of the pixels for respective colors are almost the same, and thereby the resulting data is uniform.

Figure 5:
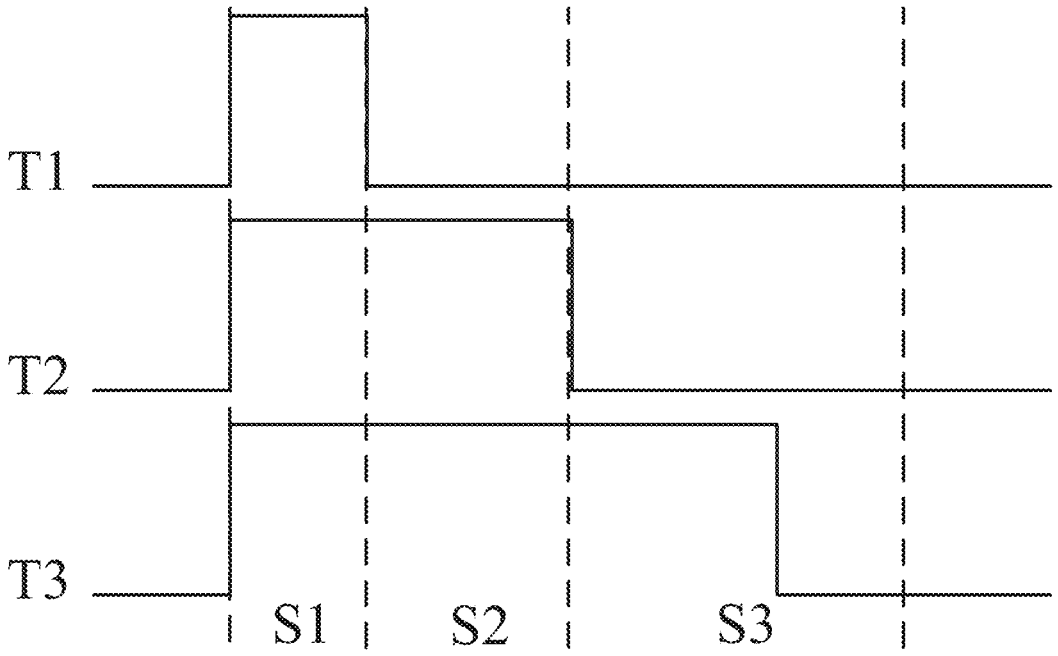
FIG. 5 is a driving timing chart of the driving current extracting circuit in FIG. 4.

In the present embodiment, the driving timing for the driving current extracting apparatus shown in FIG. 4 is as shown in FIG. 5 in particular. Hereinafter, a description will be made to the timings with reference to FIGS. 4 and 5, respectively.

In a step S1, the timing controller outputs a high level signal, turns on a first switch T1, a second switch T2 and a third switch T3, to reset a voltage of an output terminal of a first amplifier 1 to a reference voltage Vref.

In a step S2, under the function of the control signal from the timing controller, the first switch T1 is turned off, while the second switch T2 and the third switch T3 still remain on. At this time, the first capacitor C1 is charged by the current flowed from the pixel driving circuit 4, the quantity of electricity across both ends of the first capacitor C1 increases linearly with time, and thus the voltage at the output terminal of the first amplifier 1 varies linearly with time.

In a step S3, under the function of the control signal from the timing controller, the second switch T2 and the third switch T3 are turned off sequentially to obtain voltage values of a second capacitor C2 and a third capacitor C3, wherein the time period in which the third switch T3 remains on is longer than the time period in which the second switch T2 remains on. Therefore, the voltage stored by the third capacitor C3 is larger than that stored by the second capacitor C2. With the voltages stored by the second capacitor C2 and the third capacitor C3 as the input of the fully differential operational amplifier 2, the voltage difference between the second capacitor C2 and the third capacitor C3 is computed and amplified by the fully differential operational amplifier 2.

The following step is further comprised after the step S3.

In a step S4, the amplified voltage difference is input into the differential A/D converter 3, to obtain the required digital signal.

The above descriptions are only for illustrating the embodiments of the present disclosure, and in no way limit the scope of the present disclosure. Those of ordinary skill in the art may make various variations and modifications without departing from the spirit and scope of the present disclosure. Hence, all the equivalent technical solutions also fall within the protection scope of the present disclosure.

What is claimed is:

1. A pixel driving current extracting apparatus, comprising driving current extracting circuits corresponding to pixel driving circuits for respective colors respectively, each of the driving current extracting circuits comprising:

a driving current amplifying and converting unit connected to the pixel driving circuit, for amplifying and converting a driving current of the pixel driving circuit into a voltage signal;

and a driving current computing unit connected to the driving current amplifying and converting unit, for computing a pixel driving current according to the voltage signal;

wherein the driving current amplifying and converting unit comprises a first amplifier and a first capacitor;

a first input terminal of the first amplifier is connected to an end of the first capacitor and the pixel driving circuit corresponding to the driving current extracting circuit, and a second input terminal of the first amplifier is connected to a reference voltage;

an output terminal of the first amplifier is connected to the other end of the first capacitor and the driving current computing unit;

an amplification ratio of the first amplifier in the driving current extracting circuits corresponding to the pixel driving circuits for respective colors is inversely proportional to the magnitude of the pixel driving current for respective colors, the driving current computing unit is used for performing operations of differentiating and amplifying after dividing the voltage signal to obtain the pixel driving current, the driving current computing unit comprises a second amplifier, a second switch, a third switch, a second capacitor and a third capacitor;

the output terminal of the first amplifier is connected to an end of the second switch and an end of the third switch, respectively;

the other end of the second switch is connected to an end of the second capacitor and a first input terminal of the second amplifier, respectively, and the other end of the second capacitor is grounded; and the other end of the third switch is connected to an end of the third capacitor and a second input terminal of the second amplifier, respectively, and the other end of the third capacitor is grounded.

2. The pixel driving current extracting apparatus of claim 1, wherein the driving current amplifying and converting unit further comprises a first switch connected in parallel with the first capacitor.

3. The pixel driving current extracting apparatus of claim 1, wherein the pixel driving current extracting apparatus comprises the driving current extracting circuits corresponding to the pixel driving circuits for a red color, a green color and a blue color, respectively;

among the driving current extracting circuits corresponding to the pixel driving circuits for the red color, the green color and the blue color, the amplification ratio of the first amplifier in the driving current extracting circuit corresponding to the pixel driving circuit for the green color is the largest, and the amplification ratio of the first amplifier in the driving current extracting circuit corresponding to the pixel driving circuit for the blue color is the smallest.

4. The pixel driving current extracting apparatus of claim 2, wherein the first switch, the second switch and the third switch are all switch transistors.

5. The pixel driving current extracting apparatus of claim 4, wherein the first switch, the second switch and the third switch are connected to a timing controller, respectively, the timing controller being used for controlling on-off timings of the first switch, the second switch and the third switch, respectively.

6. The pixel driving current extracting apparatus of claim 1, wherein the driving current computing unit further comprises a differential analog to digital converter connected to an output terminal of the second amplifier, the differential analog to digital converter being used for converting an analog signal into a digital signal.

7. The pixel driving current extracting apparatus of claim 1, wherein the first amplifier is an operational amplifier for converting an input current into a voltage, and the second amplifier is a fully differential operational amplifier for computing and amplifying an voltage difference between the second capacitor and the third capacitor.

8. A pixel driving current extracting method, comprising the steps of:

extracting a driving current, amplifying and converting by a driving current amplifying and converting unit the driving current of a pixel driving circuit into a voltage signal;

and computing the driving current to perform the operations of differentiating and amplifying after dividing the voltage signal to obtain a pixel driving current, wherein the driving current amplifying and converting unit comprises a first amplifier and a first capacitor;

a first input terminal of the first amplifier is connected to an end of the first capacitor and the pixel driving circuit corresponding to the driving current extracting circuit, and a second input terminal of the first amplifier is connected to a reference voltage;

an output terminal of the first amplifier is connected to the other end of the first capacitor and the driving current computing unit;

an amplification ratio of the first amplifier in the driving current extracting circuits corresponding to the pixel driving circuits for respective colors is inversely proportional to the magnitude of the pixel driving current for respective colors, further comprising the steps of:

turning on a first switch, a second switch and a third switch, to reset a voltage of an output terminal of a first amplifier to a reference voltage (S1);

turning off the first switch, to charge a first capacitor by a current inputted from the pixel driving circuit (S2); and turning off the second switch and the third switch sequentially to obtain voltage values of a second capacitor and a third capacitor, and computing and amplifying a voltage difference between the second capacitor and the third capacitor by a second amplifier (S3).

9. The pixel driving current extracting method of claim 8, further comprising the step of: inputting the amplified voltage difference into a differential analog to digital converter, to obtain a digital signal (S4).

10. The pixel driving current extracting apparatus of claim 2, wherein the pixel driving current extracting apparatus comprises the driving current extracting circuits corresponding to the pixel driving circuits for a red color, a green color and a blue color, respectively;

among the driving current extracting circuits corresponding to the pixel driving circuits for the red color, the green color and the blue color, the amplification ratio of the first amplifier in the driving current extracting circuit corresponding to the pixel driving circuit for the green color is the largest, and the amplification ratio of the first amplifier in the driving current extracting circuit corresponding to the pixel driving circuit for the blue color is the smallest.

11. The pixel driving current extracting apparatus of claim 2, wherein the driving current computing unit further comprises a differential analog to digital converter connected to an output terminal of the second amplifier, the differential analog to digital converter being used for converting an analog signal into a digital signal.

12. The pixel driving current extracting apparatus of claim 2, wherein the first amplifier is an operational amplifier for converting an input current into a voltage, and the second amplifier is a fully differential operational amplifier for computing and amplifying an voltage difference between the second capacitor and the third capacitor.

13. The pixel driving current extracting apparatus of claim 5, wherein the first amplifier is an operational amplifier for converting an input current into a voltage, and the second amplifier is a fully differential operational amplifier for computing and amplifying an voltage difference between the second capacitor and the third capacitor.

14. The pixel driving current extracting apparatus of claim 6, wherein the first amplifier is an operational amplifier for converting an input current into a voltage, and the second amplifier is a fully differential operational amplifier for computing and amplifying an voltage difference between the second capacitor and the third capacitor.

* * * * *